US006245197B1

(12) United States Patent
Oriaran et al.

(10) Patent No.: US 6,245,197 B1
(45) Date of Patent: Jun. 12, 2001

(54) TISSUE PAPER PRODUCTS PREPARED WITH AN ION-PAIRED SOFTENER

(75) Inventors: T. Philips Oriaran; Anthony O. Awofeso, both of Appleton; Gary L. Schroeder; David W. White, both of Neenah; Nga Thuy Luu, Appleton; Bruce J. Kokko, Neenah, all of WI (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/421,542

(22) Filed: Oct. 20, 1999

(51) Int. Cl.[7] ..... B31F 1/12

(52) U.S. Cl. ..... 162/112; 162/158; 162/111; 162/179; 162/183

(58) Field of Search ..... 162/112, 158, 162/179, 111, 183

(56) References Cited

U.S. PATENT DOCUMENTS

| | | | | |
|---|---|---|---|---|
| 3,556,931 | | 1/1971 | Champaigne . | |
| 3,998,690 | * | 12/1976 | Lyness | 162/141 |
| 4,351,699 | | 9/1982 | Osborn, III . | |
| 4,441,962 | | 4/1984 | Osborn, III . | |
| 4,940,513 | | 7/1990 | Spendel . | |
| 5,217,576 | | 6/1993 | Van Phan . | |
| 5,223,096 | | 6/1993 | Phan et al. . | |
| 5,240,562 | | 8/1993 | Phan et al. . | |
| 5,262,007 | | 11/1993 | Phan et al. . | |
| 5,279,767 | | 1/1994 | Phan et al. . | |
| 5,494,731 | | 2/1996 | Fereshtehkhou et al. . | |

OTHER PUBLICATIONS

1996 Annual Book of ASTM Standards, pp. 108–111.
Ullman's Encyclopedia of Industrial Chemistry, 5$^{th}$ Edition, pp. 747, 752–756 (1994).
Hughes et al., "Radiotracer and Celloidal Study of Fabric Softer Action", Text. Chem. Color, vol. 10, No. 5 (1978).
Kirk–Othmer Encyclopedia of Chemical Technology, Fourth Edition, vol. 23, pp. 488–491 (1997).

* cited by examiner

*Primary Examiner*—Stanley S. Silverman
*Assistant Examiner*—Mark Halpern
(74) *Attorney, Agent, or Firm*—Nixon Peabody LLP

(57) ABSTRACT

A tissue paper of improved softness, strength and absorbency; and a manufacturing process for such a tissue paper where the generation of foam is reduced, or eliminated altogether. These are obtained using a tissue paper softener system comprising a substantially equimolar, ion-paired mixture of an anionic surfactant and a cationic quaternary ammonium compound, wherein the softener system is formulated such that the charge density of the anionic surfactant/cationic quaternary ammonium compound mixture will be about neutral.

35 Claims, 3 Drawing Sheets

Wt% Witconate AOS in 0.1% Varisoft 475

(The Concentration of Varisoft 475 is kept constant)

Molar Ratio of Witconate AOS in 0.1% Varisoft 475
(The Concentration of Varisoft 475 is kept constant)

TISSUE PAPER PRODUCTS PREPARED WITH AN ION-PAIRED SOFTENER

This invention relates to paper products in general (e.g., paper towels, facial tissues napkins and sanitary (toilet) tissues), and more particularly, to tissue paper products which have been prepared using an ion-paired softener. The invention also relates to processes used for the manufacture of such tissue papers.

BACKGROUND OF THE INVENTION

For some time paper makers have sought ways to make tissue papers which are soft, yet have sufficient strength.

U.S. Pat. No. 3,556,931 describes treating a sheet of paper with a quaternary ammonium salt debonding agent to soften the sheet. The debonding agent is sprayed on the sheet prior to passing the sheet through a drier.

U.S. Pat. Nos. 4,351,699 and 4,441,962 describe the addition of a quaternary ammonium compound, and at least one specified nonionic surfactant into an aqueous papermaking furnish for making soft, absorbent products such as paper towels. The addition of only quaternary ammonium debonding agents is said to enhance softness, but will also decrease absorbency. The nonionic surfactants are added to overcome the problem of reduced absorbency.

U.S. Pat. No. 4,940,513 describes treating tissue paper with a noncationic surfactant to impart softness. The noncationic surfactants are said to include anionic, nonionic, ampholytic and zwitterionic surfactants. The noncationic surfactants are preferably sprayed on the wet tissue web as it courses through the papermaking machine.

U.S. Pat. Nos. 5,217,576; 5,223,096; 5,240,562; 5,262,007; and 5,279,767 describe the use of quaternary ammonium compound debonding agents for softening tissue paper. Anionic surfactants are described as optional ingredients which can be added to the papermaking furnish so long as they do not significantly and adversely affect the softening, absorbency, and wet strength enhancing actions of the required chemicals.

U.S. Pat. No. 5,494,731 describes tissue papers which have been treated with certain nonionic softeners. The background portion of this document describes certain disadvantages of using cationic debonding agents.

There are numerous problems we have observed with available tissue papers. For example, softness and strength are two important attributes of tissue and towel products. Typically, however, one of those attributes is enhanced at the expense of the other.

One effective technique for enhancing the softness of tissue and towel products is the addition of cationic softeners or debonders to the fiber furnish from which the tissue or towel is made at the wet end of the papermaking system. Unfortunately, the addition of cationic debonders to fiber furnish at the wet end often results in significant reduction of tensile strength (e.g., 15–50% depending on amount added and point of addition). Usually, the furnish, to which debonders are added, is then subjected to refining or the addition of dry strength additives to negate the strength reduction that occurs because of debonder addition. Such treatments, however, often negate the softness benefits imparted by debonder addition. Depending on the type of debonders added, the absorbency rate of the tissue and towel products can also be decreased because of the hydrophobic groups associated with the various debonder formulations.

Cationic debonders, because of their positive charge, are retained on the fiber. On the other hand, anionic softeners and surfactants, because they have the same charge as the fiber, are not sufficiently retained on fiber when they are added to the wet end of the papermaking process. As such, they typically do not function effectively as softeners. They do, however, contribute to wet-end deposition and significant foaming that is detrimental to paper machine operation.

Accordingly, it is an object of the invention to provide a tissue paper product of improved softness, strength and absorbency. It is also an object to provide a manufacturing process for such a tissue paper product where the generation of foam is reduced, or eliminated altogether.

SUMMARY OF THE INVENTION

We have addressed the aforementioned problems through the discovery and development of a softener additive that can enhance softness with minimal strength loss, that will not retard absorbency; and that will not foam significantly when incorporated with the furnish at the wet end of the papermaking system.

We have discovered what we call an ion-paired softener system. The invention, therefore relates to a tissue paper softener system comprising an ion-paired mixture of an anionic surfactant and a cationic amphiphilic compound, wherein the softener system is formulated such that the charge density of the anionic surfactant/cationic amphiphilic compound mixture will be about neutral.

In another embodiment there is provided a process for making a soft, absorbent tissue paper web comprising the steps of forming an aqueous papermaking furnish, depositing the furnish on a foraminous surface, and removing the water from the furnish. An ion-paired softener system according to the invention is added to the furnish or web.

DETAILED DESCRIPTION OF THE PREFERRED EMBODIMENTS

Figure 1:
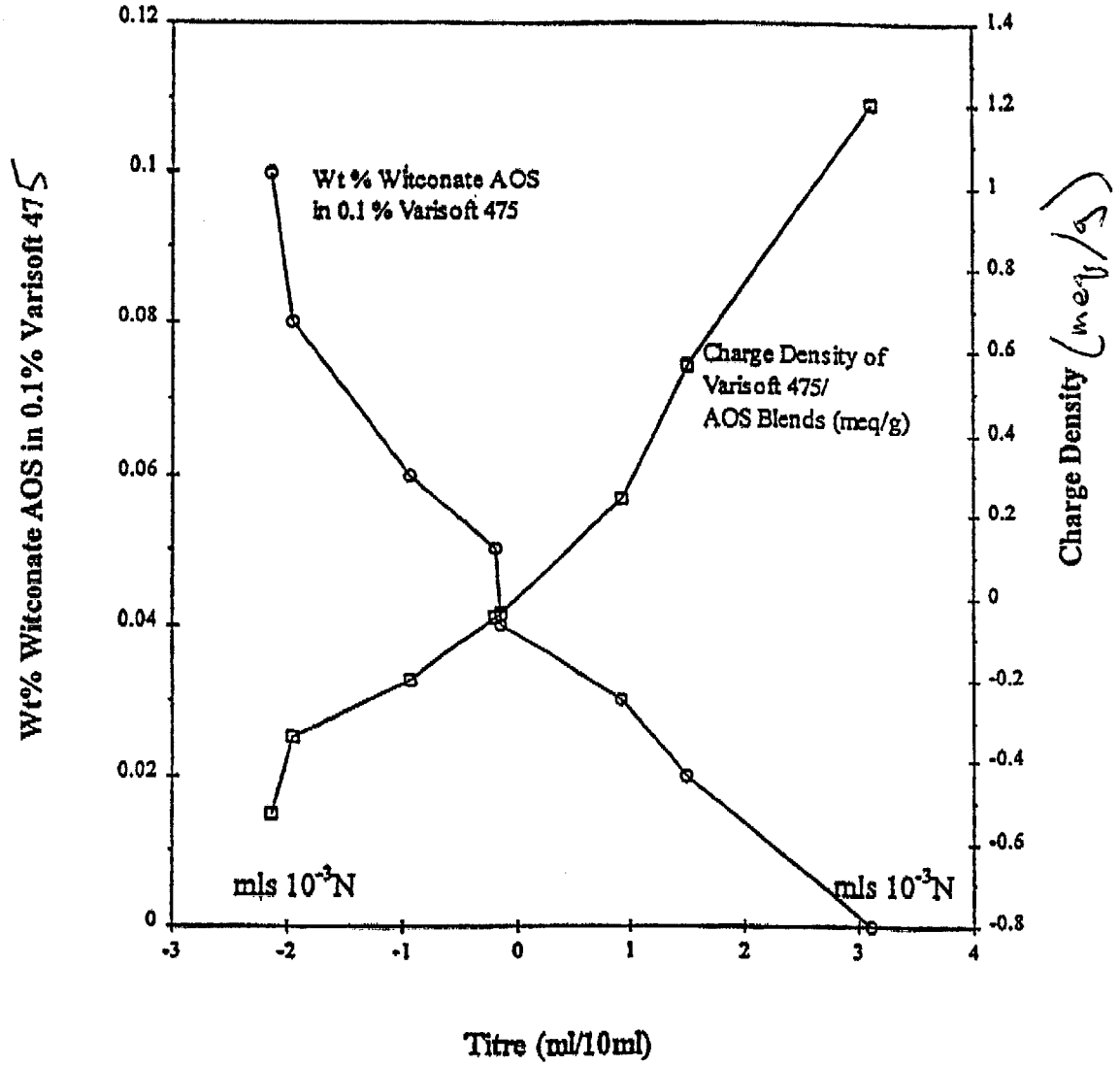
FIG. 1 is a plot of charge densities of the paired systems in Examples 1–11 versus a sample titer.

Various types of tissue paper products can be made using the softener system of the invention. These would include paper towels, napkins, facial tissues and sanitary (toilet) tissues.

The softener systems of the invention can be used with any technique for preparing tissue paper products. For example, a tissue paper web can first be prepared by depositing a papermaking furnish on a foraminous forming wire, also known as a Fourdrinier wire, to provide a web. The web can then be dewatered by pressing the web and drying at elevated temperatures. In a typical process, a low consistency pulp furnish can be provided from a pressurized headbox. The head box will have an opening for delivering a thin deposit of pulp furnish onto the Fourdrinier wire to form a wet web. The web will then be dewatered to fiber consistency of between about 7% and about 25% (total web weight basis) by vacuum dewatering and further dried by pressing operations where the web will be subjected to pressure developed by opposing mechanical members such as cylindrical rolls. The dewatered web can then be further pressed and dried by a steam drum apparatus known in the art as a Yankee dryer. Pressure can be developed at the Yankee dryer by mechanical means such as an opposing cylindrical drum pressing against the web. Multiple Yankee dryer drums can be employed for additional pressing if necessary or desirable. Subsequent processing may also be used such as creping, calendering and/or reeling, etc., to further increase stretch, bulk and softness, and to control caliper.

The softener systems of the invention will be recognized by those skilled in the art to be useful in connection with producing many types of tissue paper products. Thus, they may be used, for example, to prepare conventionally felt-pressed tissue papers; high bulk pattern densified tissue paper; and high bulk, uncompacted tissue papers. The tissue paper can be of a homogeneous or multi-layered construction; and the tissue paper products made therefrom can be of a single-ply or multi-ply construction. The aforementioned tissue papers, and their methods of manufacture, are described in detail in U.S. Pat. No. 5,494,731, the contents of which is incorporated herein by reference in its entirety.

Conventional papermaking fibers may also be utilized for the invention. Preferred are those derived from wood pulp, although synthetic fibers and fibers made from other cellulosic fibrous pulps may be used as well. Applicable wood pulps include, among others, chemical pulps and mechanical pulps.

The terminology "ion-pair" as used in connection with this invention refers to the close juxtaposition of two oppositely charged chemical species. A simple example of that phenomenon is that when an ionic molecule, for example, ammonium chloride ($NH_4Cl$) is dissolved in water.

$$NH_4Cl+H_2O \leftrightarrow NH_4^+Cl^-+\text{excess } H_2O \leftrightarrow NH_4^++Cl^-$$

The initially formed species is an ion-pair. However, the water molecule has a dipolar character, due to the bond angles between the oxygen and hydrogens, and the anionic and cationic moieties become surrounded by water molecules of hydration. The extent of hydration is influenced by the strength of the electric field emanating from the ion. The hydrating water dipoles reduce the electrostatic attraction between the initially formed ion-pair thereby resulting in the complete dissociation to free hydrated ions.

Introducing poorly hydrated hydrocarbon moieties, e.g., alkyl, alkenyl, arylalkyl, etc., into the chemical structure of the ionic molecule in place of the hydrogens would reduce the overall extent of hydration of the cationic species and localize it around the ionic portion of the molecule. These amphiphilic ions are the preferred ions for the ion pairs of this invention.

There are large numbers of anionic surfactants, and large numbers of cationic compounds, which are potentially suitable for use in connection with the invention, provided they are properly electrovalently paired. The preferred anionic surfactant for use in connection with the invention is an alkenyl olefin sulfonate (AOS) having from 8 to 22 carbon atoms, more preferably from 12 to 18 carbon atoms, and most preferably a total of at least about 16 carbon atoms. A preferred AOS is a sodium alpha olefin sulfonate, which has the formula, $CH_3(CH_2)_nCH{=}CH(CH_2)SO_3^-Na^+$.

A preferred commercially available anionic surfactant is an alkenyl olefin sulfonate known as Witconate® AOS, available from Witco. Witconate®AOS is an alkenyl olefin sulfonate containing a $C_{16}$ fraction. The $C_{16}$ fraction of Witconate® AOS has been observed to be selectively retained in the tissue sheet in favor of the $C_{14}$ fraction. This suggests that anionic surfactants with $C_{16}$ or higher fractions should be used.

Examples of possible other anionic surfactants include, for example carboxylates such as carboxymethylated ethoxylates, and amino acid derivatives, sulfonates such as akylbenzenesulfonates, alkylnaphthalenesulfonates, alkanesulfonates, α-olefin sulfonates, α-sulfo fatty acid esters, sulfosuccinates, and alkoxyalkane-, acyloxyalkane-, and acylaminoalkanesulfonates, sulfates such as alkyl sulfates and ether sulfates, alkyl phosphates, and anionic silicone surfactants.

The preferred cationic agent is an imidazolinium compound. A preferred example of such a compound is 3-methyl-2-tallow-1-(2-tallowamidoethyl)imidazolinium methylsulfate. However, others based on fatty chains other than tallow, for example, cetyl, palmityl, stearyl, behenyl, oleyl, and mixtures thereof, may also be used. Accordingly, the preferred softener of the invention provides ion-pairs formed from a mixture of 3-methyl-2-tallow-1-(2-tallowamidoethyl)imidazolinium methylsulfate ($Im^+$) and an alkali metal alkenyl olefin sulfonate (AOS), where the molar ratio, $Im^+$/AOS is about 1.

A preferred commercially available cationic agent is Varisoft® 475, a product which includes 3-methyl-2-tallow-1-(2-tallowamidoethyl)imidazolinium methylsulfate, and is available from Witco Chemical Company of Greenwich, Conn.

As noted above, it is possible to form ion-pair softening systems between other classes of cationic and anionic compounds depending on the valence of the oppositely charged ions. For example, the cations of the following classes of compounds can be electrovalently paired with the anions of different surfactants: cationic fatty amine amides, dialkyl dimethyl quaternary ammonium compounds, diamidoamine-based quaternary ammonium compounds, monomethyl trialkyl-based quaternary ammonium compounds, monoalkyl trimethyl quaternary ammonium compounds, tetra alkyl quaternary ammonium compounds, methyl dialkoxyl alkyl quaternary ammonium compounds and cationic silicone compounds.

While numerous candidates exist, the anionic surfactant and cationic compound should be selected and blended in a manner to minimize the dissociation to free ions of the anionic surfactants and cationic compounds. Therefore, an equimolar mixture (1:1) of an anionic surfactant and a cationic compound used in accordance with the invention should conform with the following formula where $\text{Mol.Wt.}_{(CC)}$ and $\text{Mol.Wt.}_{(AS)}$ refer to the molecular weight of the cationic compound and the anionic surfactant, respectively, and $\text{Wt. }(\%)_{(CC)}$ and $\text{Wt. }(\%)_{(AS)}$ are the weight percent of the cationic compound and the anionic surfactant, respectively.

$$\frac{\text{Mol. Wt.}_{(CC)}}{\text{Mol. Wt.}_{(AS)}} = \frac{\text{Wt. }(\%)_{(CC)}}{\text{Wt. }(\%)_{(AS)}} \quad \text{(I)}$$

If the oppositely charged molecules of the anionic surfactant and cationic compound are in close association and form an ion-pair because of ionic or electrovalent attraction, then the charge density of the anionic surfactant/cationic compound pair will be about neutral, and conform substantially with the following formula, where [AS] and [CC] are the concentrations (wt %) of the anionic surfactant and the cationic compound, respectively, and CD stands for charge density expressed in terms of meq/gm.

$$([AS])(CD_{(AS)})+([CC])(CD_{(CC)}))=CD_{(PAIR)}=0 \quad \text{(II)}$$

The charge densities can be determined using titratable charges of the anionic surfactant and cationic compound solutions, and the anionic surfactant/cationic compound blends. Samples can be titrated with PVSK (Potassium salt of Polyvinyl Sulfate) or DADMAC (Poly Diallyl Dinethyl Ammonium Chloride) using a Mutek PCD-02 streaming current detector as the titration end point detector. These tests will give a measure of the residual charge carried by the associated particles in each sample.

Formula (I) and formula (II) above provide those skilled in the art with formulation tools for achieving ion-paired softener systems of virtually equimolar and virtually neutral mixtures of the anionic surfactant and cationic compound. While it is preferred that the mixtures be exactly equimolar and have an exactly neutral charge density, when used in practice slight variations from exactly equimolar and neutral can be expected. However, these mixtures are considered to be within the scope of the invention as the improvements and advantages of the invention can still be obtained. An examples of this would be the combination of the aforementioned Witconate® AOS and Varisoft® 475 at a molar ratio of Witconate® AOS/Varisoft® 475 of about 0.5 to about 1.5, and more preferably about 0.75 to about 1.25; with 1.0 being the most preferred.

As noted above, anionic softeners and surfactants, because they have the same charge as the fiber, are not retained adequately on fiber when they are added to the wet end. As such, they are typically not effective softeners. Appropriate ion-pairing between the anionic surfactant and the cationic compound should result in a complex of larger particle size. As such, this larger particle size should enhance the retention of the anionic surfactant in the tissue paper sheet. The change in particle size can be indicated by measuring the light scattered by a range of the anionic surfactant/cationic compound mixtures at a known wavelength. The particle size of the ion-paired complex will vary depending the particular anionic surfactant and cationic agents which are used.

The amount of anionic surfactant retained in a tissue paper product prepared according to the invention can be determined, for example, by using a methanol/water extraction agent to extract the anionic surfactant. Liquid chromatography using a refractive index detector can then be used to analyze the extract for the concentration of anionic surfactant. Retention can then be expressed as a percentage of the initial amount of added anionic surfactant. Tissue paper products prepared according to the invention can exhibit a retention of about 20 to about 90%, preferably about 40 to about 80%, and more preferably, about 50 to about 70%, of the initial amount of added anionic surfactant.

By their very nature and function, cationic debonders will decrease the tensile strength of a paper web by weakening the interfiber bonds in the web. While some weakening is desirable to achieve desired softness, it is not desirable to decrease strength so much that strength enhancement is necessary. However, tissues softened using cationic debonders typically require some manner of strength enhancement. When using appropriately ion-paired softeners according to the invention, we have observed that tensile strength degradation can be reduced over that obtained with cationic debonders. That is, the amount of debonding associated with the ion-paired softeners can be lower than the amount of debonding obtained with typical cationic debonding agents. While not wishing to be bound by theory, we attribute this characteristic also to the larger sized particle for the ion-pair. Compared to a conventional debonding agent, the larger-sized particle of the ion-pair will occupy less web surface area per unit mass than the conventional debonder. The larger sized particle reduces the surface area of the web available for bond inhibition. Also, the ion-pair effectively reduces the debonding activity of the cationic component of the ion-pair by tying up the alkyl chain so that it cannot debond the fiber. As a result, another advantage of the invention is that the use of strength enhancement aids, e.g., dry strength additives, may be unnecessary.

Another problem with typical anionic surfactants is that they contribute to wet-end deposition and significant foaming that is detrimental to paper machine operation. A reduction in, or elimination of, foaming can be expected using a softener system according to the invention when added to the fiber furnish at the wet-end of the process. That is, appropriate ion-pairing between the anionic surfactant and the cationic compound will increase surface tension to levels significantly higher than those obtained when using the anionic surfactant alone, or an unbalanced blend of anionic surfactant and cationic compound. In a preferred embodiment of the invention, balanced ion-pairing of the softener system is used to control surface tension such that the surface tension of the sheet forming solution (stock solution) remains above about 60 dynes/cm, and more preferably, above about 70 dynes/cm. If the ion-pair is not balanced, the surface tension has been observed to drop significantly below 60 dynes/cm.

When preparing tissue paper webs using ion-paired softener systems of the invention virtually no foaming will result from the use of the anionic surfactant. Whether a particular ion-paired softener system provides that advantage can be determined by a simple "foam height test" ("the foam height test"). That is, 100 ml. sample solutions can be created and subjected to whipping in a Waring blender at 7 amps for 30 seconds. The whipped test samples should then be poured into a 500 ml glass graduated cylinder and the foam volume recorded in milliliters (ml). Under the conditions of this test, ion-paired softener systems according to this invention should exhibit a foam volume no greater than about 40 ml., preferably no more than about 10 ml., and more preferably no more than about 2 ml.

Appropriate ion-pairing can also address the absorbency problems found with tissues prepared using cationic debonders. The absorbency rate of the tissue and towel products can be depressed because of the hydrophobic groups associated with the various cationic debonder formulations. The hydrophilic properties associated with the anionic surfactant part of the pair will compensate for the presence of the hydrophobic groups and, therefore, enhance absorbency of the product.

Any fatty acid chains present in retained anionic surfactants and cationic compounds can also provide a benefit. That is, proper ion-pairing and resulting retention of the fatty acid chain-containing anionic surfactant and cationic compound will increase lubricity and subsequent handfeel softness in the final product.

It is preferred that the softener systems according to the invention be added to the furnish at the wet end before the Yankee dryer. The ion-paired softeners can be applied at different times or in alternate ways. For example, they can be sprayed on the sheet before creping, or after creping. However, it is important that the surfactant be retained on the sheet. Therefore, if the ion-paired softener is added prior to drying on the Yankee, the sheet should be slightly anionic. If applied after creping, the charge is unimportant.

The invention will be further illustrated with reference to the following examples. The examples, however, are given by way of illustration and are not meant to limit the invention in any way.

EXAMPLES 1–11

Reduced Foaming

Several samples of ion pairs of two oppositely charged ions of a cationic debonding agent and an anionic surfactant were prepared by increasing the concentration of an anionic surfactant (Witconate AOS) in a constant concentration of a quaternary ammonium compound (Varisoft 475). Witconate AOS and Varisoft 475 are available from WITCO Chemical Corporation and both have hydrocarbon fractions varying from C14–C18, and individual critical micelle concentrations (CMC) below 0.2% (wt).

The Varisoft 475 was prepared by dilution from a 6% Varisoft 475 concentrate to 0.1%. The Witconate AOS solution was prepared from a 40% Witconate AOS concentrate. Concentration is expressed on a weight % basis because it is temperature independent, i.e. the concentration will be the same at the same at all temperatures and will not depend on thermal expansion of the resultant solutions.

These formulations were used to compare foam height. The ion pair formulations, were tested for foam height by whipping the test samples in a Waring blender at 7 amps for 30 seconds. The ion pair formulations all had foam heights (volume) below 2 ml. In contrast, Witconate AOS alone exhibited a foam height of 20 ml., whereas Varisoft 475 alone exhibited a foam height of 0 ml.

The foaming decrease relative to the use of only the anionic surfactant is believed to be due to a change in the surface tension in the paired system. To demonstrate the effect of ion pairing on surface tension, dynamic surface tension testing was performed on the paired systems using a Sensadyne 6000 tensiometer according to ASTM Method D 3825-90. This technique used measured pressure differentials during air bubble formation at tips of two different sized capillaries to compute surface tension. The results are set forth below in Table 1.

TABLE 1

| | Wt % AOS | Surface Tension in water (dynes/cm) | Surface Tension in .10% Varisoft 475 |
|---|---|---|---|
| Example 1 | — | 71.0 | 71.0 |
| Example 2 | 0.01 | 66.4 | 70.95 |
| Example 3 | 0.02 | 55.3 | 70.9 |
| Example 4 | 0.03 | not tested | 70.8 |
| Example 5 | 0.04 | 39.5 | 70.4 |
| Example 6 | 0.05 | not tested | 70.0 (equimolar) |
| Example 7 | 0.06 | not tested | 69.5 |
| Example 8 | 0.01 | not tested | 67.8 |
| Example 9 | 0.08 | not tested | 66.1 |
| Example 10 | 0.09 | not tested | 64.0 |
| Example 11 | 0.10 | 37.7 | 61.8 |

The results from Examples 2–11 demonstrate that by juxtapositioning or pairing the anions of the Witconate AOS surfactant and the cation of a quaternary ammonium compound, the surface tension of the paired system is higher than the surface tension of the anionic surfactant only.

EXAMPLE 12

Confirming a Neutral Charge Density

The titratable charge of the Varisoft 475/Witconate AOS paired systems in Examples 2–11 were measured by titrating the samples with PVSK (Potassium Salt of Polyvinyl Sulfate) or DADMAC (Poly Diallyl Dimethyl Ammonium Chloride) using a Mutek PCD-02 streaming current detector as titration end point detector. These tests gave a measure of the residual charge carried by the associated particles in each Varisoft 475/AOS ion pair. FIG. 1 shows a plot of charge densities of the paired systems in Examples 1–11 versus a sample titer (ml/10 ml). The results demonstrates that if a molecule of Varisoft 475 carying one unit positive charge, and a molecule of Witconate AOS carrying one unit negative charge are in close association and form an ion pair because of ionic or electrovalent interaction, then the charge density of the Varisoft 475/Witconate AOS paired system will be neutral.

EXAMPLE 13

Increased Particle Size

This example was performed to demonstrate that if one mole of Varisoft 475 electrovalently associates closely with one mole of the Witconate AOS to form an ion pair, the association will result in an ion-paired species with increased particle size. The changes in particle size of the ion paired systems of Examples 2–11 is graphically illustrated in FIG. 2 for three temperature regimes, and were measured at 580 nm immediately after inverting 1-cm glass curvette at three temperature regimes. For the higher temperature regimes, samples were heated for one hour in a water bath prior to absorbance measurements.

Figure 2:
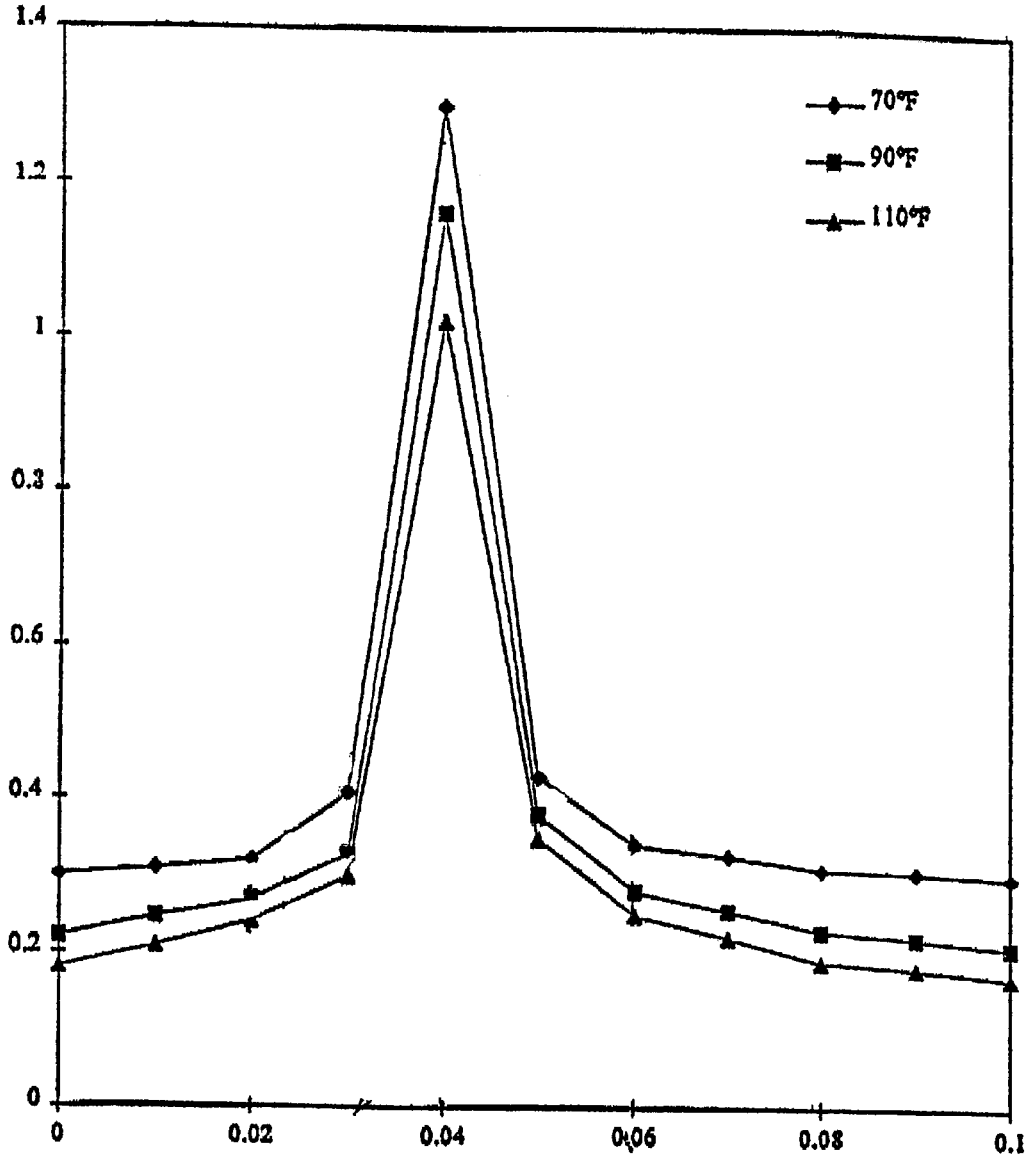
FIG. 2 graphically illustrates changes in particle size of the paired systems of Examples 2–11.

As shown in FIG. 2, as the concentration of Witconate AOS added to 0.1% Varisoft 475 increases, light absorbance of the mixture increases slowly until 0.03 wt % AOS. Beyond this point, the light absorbance curve increases sharply and reaches a maximum at 0.04 wt % AOS. From this point, a sharp decrease in the slope of the light absorbance curve to 0.05 wt. % AOS occurred followed by a steady decrease in light absorbance to 0.10 wt. % AOS. This trend is consistent for all three temperatures. The fact that light absorbance was highest when the weight percentage of AOS was 0.04 wt % indicates that largest particle sizes are formed at this concentration (at an equimolar blend). In fact, a precipitate formed at 0.04 wt % which was visible to the naked eye. That did not occur at any of the other data points shown in FIG. 2. This result confirms that when the two molecular species form an ion pair, they result in a product that exhibits a much larger particle size than those formulations that do not ion pair.

Figure 3:
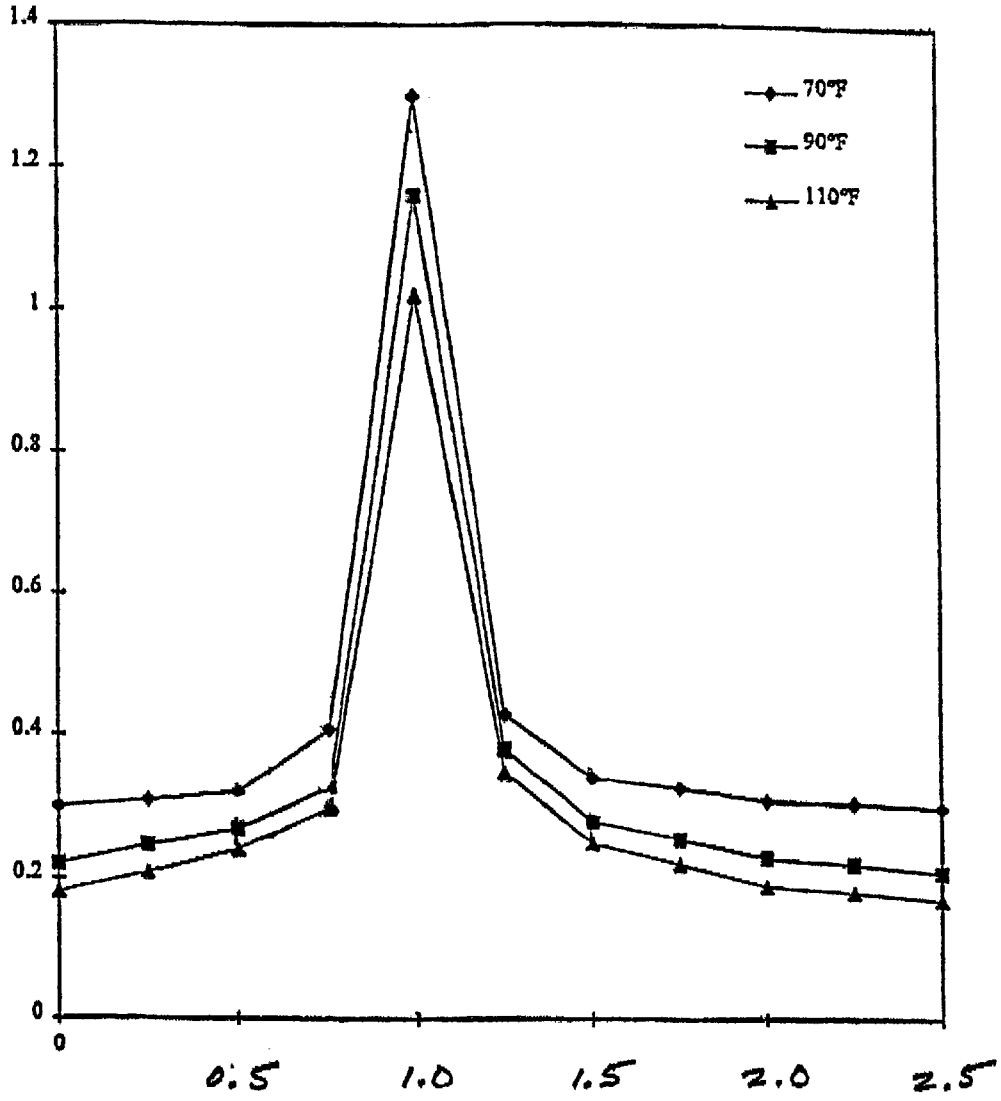
FIG. 3 also graphically illustrates changes in particle size of the paired systems of Examples 2–11.

FIG. 3 is a plot of the absorbance results showing the corresponding molar ratios, i.e., Witconate® AOS/Varisoft® 475.

EXAMPLE 14

Comparison of Properties Including Softness, Absorbency and Formation

Tissue paper base sheet samples treated with Witconate AOS anionic surfactant, Varisoft 475 cationic debonder and the ion pair of Example 6 were produced on a papermachine to demonstrate gains in softness, absorbency and formation. The amount of cationic starch (Solvitose®-N) used to attain target strength levels was the same for control and ion pair treated products, but higher for products treated only with the cationic debonder.

The papermachine was an inclined suction breast roll former operated in the waterfonned mode, and maintained at a speed of 100 ft/min. The furnish was a 60/40 blend of Southern HWK and Southern SWK. As noted above, cationic starch, i.e., Solvitose®-N, supplied by Nalco Chemical Co., was added to the furnish as required to attain target strength.

For the ion paired sample, an aqueous dispersion of the ion pair softener was added to the furnish containing the cationic starch at the stuff box downleg, as it was being transported through a single conduit to the headbox. The stock comprising of the furnish, the strength additive and the ion pair softener was delivered to the forming fabric to form a nascent/embryonic web. Dewatering of the nascent web occurred via conventional wet pressing process and drying on a Yankee dryer. Adhesion and release of the web from the Yankee dryer was aided by the addition of Houghton 8296 adhesive and Houghton 565/8302 release agents, respectively. Yankee dryer temperature was approximately 190° C. The web was creped from the Yankee dryer with a square blade at an angle of 75 degrees at sheet moisture below 5%. The softened tissue paper product had a basis weight of 18–19 lb./ream, MD stretch of 18–29%, approximately 0.05 to 0.8% of softener by weight of dry paper, and CD dry tensile greater than 180 grams/3 inches.

A control sample and samples using only the Witconate AOS anionic surfactant and only the Varisoft 475 cationic debonder were prepared in the same way. The Basis weight, Basesheet strength (Geometric Mean Tensile Strength (GMT)), Geometric Mean (GM) Modulus, Surface friction (GMMMD), formation, water absorption, and sensory softness characteristics of the samples are set forth below in Table 2.

The GM Modulus was measured as the slope of the load/strain curve for a one inch wide strip of sample at 50 grams loading during tensile testing. The results give a measure of the bulk softness of the sample with lower numbers corresponding to lower stiffness and higher bulk softness. The samples using properties of the softened tissue are shown in Table 2.

Formation data were gathered using a Robotest Emulator. Higher indices correspond to better fonnation.

Surface friction (GMMMD) was measured using the KES Friction Tester. Lower friction numbers represent improved surface softness.

TABLE 2

| | Control | Varisoft 475 Debonder | AOS | Ion Pair |
|---|---|---|---|---|
| Solvitose ® -N (lbs./ton) | 5 | 10.5 | 5 | 5 |
| Basis Wt. (lbs./ream) | 19.1 | 19.4 | 18.2 | 18.6 |
| GMT(G/3") | 934 | 985 | 907 | 911 |
| GM Modulus (g/% strain) | 23.3 | 26.9 | 20.6 | 23.2 |
| Friction (GMMMD) | .247 | .227 | .207 | .215 |
| Formation | 64.3 | 64.6 | 64.5 | 67.4 |

TABLE 2-continued

| | Control | Varisoft 475 Debonder | AOS | Ion Pair |
|---|---|---|---|---|
| Water Absorption Rate (sec.) | 1.08 | 1.11 | 0.61 | 0.78 |
| Sensory Softness | 15.78 | 16.05 | 15.47 | 16.03 |

EXAMPLE 15

Comparison of Properties at Same Basis Weight

Tissue paper base sheet samples treated with Witconate AOS anionic surfactant, Varisoft 475 cationic debonder, and the ion pair of Example 6 were produced in the same manner as Example 14, except that the basis weight of the ion pair treated tissue was adjusted to be the same as those of tissue papers treated with the surfactant and the debonder (a higher amount of the cationic strength additive was still used for the cationic debonder sample). The properties of the treated paper are shown in Table 3. The data shows that at approximately the same basis weight, tissue products treated with the ion paired softeners exhibited higher tensile strength property compared to tissue products treated with only the anionic surfactant or only the cationic debonder, even though approximately twice as much Solvitose®N dry strength enhancer was added to the tissue treated with only debonder.

TABLE 3

| | Varisoft 475 Debonder | AOS | Ion Pair | Ion Pair |
|---|---|---|---|---|
| B. Wt(lbs./r) | 19.4 | 20 | 19.5 | 20 |
| Solvitose ®-N (lbs./ton) | 10.5 | 5 | 5 | 5 |
| Caliper (mils/8 sheets) | 60.5 | 71 | 62.4 | 63.9 |
| GMT(g/3") | 985 | 984 | 1168 | 1284 |
| GM Modulus (g/strain) | 26.9 | 22.5 | 25.5 | 24.7 |
| Friction GMMMD | .227 | .236 | .222 | .262 |
| Formation | 64.6 | 63.3 | 65.1 | 66.7 |
| Water Absorption Rate (sec.) | 1.11 | 0.58 | 0.69 | 0.63 |

While the invention has been described above using preferred embodiments, it is to be understood that variations and modifications are to be considered within the purview and the scope of the invention and the claims appended hereto.

What is claimed is:

1. A tissue paper softener system substantially comprising an ion-paired mixture of an anionic surfactant and a cationic amphiphilic compound, wherein the softener system is formulated such that the charge density of the anionic surfactant/cationic compound mixture will be about neutral.

2. A tissue paper softener system according to claim 1, wherein the cationic compound is cationic quaternary ammonium compound.

3. A tissue paper softener system according to claim 1, wherein the molar ratio of anionic surfactant to cationic compound in the softener system is from about 0.5 to about 1.5.

4. A tissue paper softener system according to claim 3, wherein the molar ratio of anionic surfactant to cationic compound in the softener system is from about 0.75 to about 1.25.

5. A tissue paper softener system according to claim 1, wherein said anionic surfactant is an alkenyl olefin sulfonate.

6. A tissue paper softener according to claim 5, wherein said anionic surfactant is an alkenyl olefin sulfonate comprising a carbon chain containing least about 16 carbon atoms.

7. A tissue paper softener system according to claim 1, wherein said cationic compound is selected from the group of imidazolines which includes 3-methyl-2-alkyl-1-(2-alkylamidoethyl)imidazolinium methyl sulfate; cationic fatty amine amides; dialkyl dimethyl quaternary ammonium compounds; diamidoamine-based quaternary ammonium compounds; monomethyl trialkyl-based quaternary ammonium compounds; monoalkyl trimethyl quaternary ammonium compounds; tetra alkyl quaternary ammonium compounds; methyl dialkoxy alkyl quaternary ammonium compounds; and cationic silicone compounds.

8. A tissue paper softener system according to claim 7, wherein said cationic compound is an imidazolnium which includes 3-methyl-2-alkyl-1-(2-alkylamidoethyl) imidazolinium methyl sulfate.

9. A tissue paper softener system according to claim 8, wherein said cationic compound is a 3-methyl-2-tallow-1 (2-tallowamidoethyl)imidazolinium methylsulfate.

10. A tissue paper softener system according to claim 7, wherein said anionic surfactant is selected from carboxylates, sulfonates, sulfates, alkyl phosphates, and anionic silicone surfactants.

11. A tissue paper softener system according to claim 9, wherein said anionic surfactant is a alkenyl olefin sulfonate comprising a carbon chain containing at least about 16 carbon atoms.

12. A tissue paper softener system according to claim 7, wherein said anionic surfactant is an alkenyl olefin sulfonate.

13. A tissue paper softener system according to claim 7, wherein the anionic surfactant is selected from those which, when ion-paired with the cationic compound, will exhibit a processing foam volume no greater than about 10 ml, as measured by the foam height test.

14. A tissue paper softener system according to claim 11, wherein the anionic surfactant is selected from those which, when ion-paired with the cationic compound, will exhibit a processing foam volume no greater than about 2 ml, as measured by the foam height test.

15. A paper product prepared using a tissue paper softener system comprising an ion-paired mixture of an anionic surfactant and a cationic amphiphilic compound, wherein the softener system is formulated such that the charge density of the anionic surfactant/cationic compound mixture will be about neutral.

16. A paper product according to claim 15, wherein the paper product is a paper towel.

17. A paper product prepared using the tissue paper softener system comprising an ion-paired mixture of an anionic surfactant and a cationic amphiphilic compound, wherein the softener system is formulated such that the charge density of the anionic surfactant/cationic compound mixture will be about neutral, and wherein said anionic surfactant is an alkenyl olefin sulfonate comprising a carbon chain containing at least about 16 carbon atoms and said cationic compound is a 3-methyl-2-tallow-1(2-tallowamidoethyl)imidazolinium methylsulfate.

18. A paper product according to claim 17, wherein the paper product is a paper towel.

19. A paper product prepared using a tissue paper softener system comprising an ion-paired mixture of an anionic surfactant and a cationic amphiphilic compound, wherein the softener system is formulated such that the charge density of the anionic surfactant/cationic compound mixture will be about neutral, and wherein said anionic surfactant is an alkenyl olefin sulfonate and said cationic compound is selected from the group of imidazolines which includes 3-methyl-2-alkyl-1-(2-alkylamidoethyl)imidazolinium methylsulfate; cationic fatty amine amides; dialkyl dimethyl quaternary ammonium compounds; diamidoamine-based quaternary ammonium compounds; monomethyl trialkyl quaternary ammonium compounds; monoalkyl trimethyl quaternary ammonium compounds; tetra alkyl quaternary ammonium compounds; methyl dialkoxy alkyl quaternary ammonium compounds; and cationic silicone compounds.

20. A tissue paper softener system comprising a mixture of an of an anionic surfactant and a cationic amphipbilic compound, said mixture consisting essentially of ion-paired combinations of the anionic surfactant and the cationic compound, wherein the softener system is formulated such that the charge density of the anionic surfactant/cationic compound mixture will be about neutral.

21. A tissue paper softener system according to claim 20, wherein the cationic compound is cationic quaternary ammonium compound.

22. A paper product prepared using a tissue paper softener system comprising a mixture of an anionic surfactant and a cationic amphiphilic compound, said mixture consisting essentially of ion-paired combinations of the anionic surfactant and the cationic compound, wherein the softener system is formulated such that the charge density of the anionic surfactant/cationic compound mixture will be about neutral.

23. A paper product according to claim 22, wherein the paper product is a paper towel.

24. A process for making a soft, absorbent tissue paper web comprising the steps of forming an aqueous papermaking furnish, depositing said furnish on a foraminous surface, and removing the water from said furnish, wherein an ion-paired softener system is added to said furnish or web, said softener system substantially comprising an ion-paired mixture of an anionic surfactant and a cationic amphiphilic compound wherein the softener system is formulated such that the charge density of the anionic surfactant/cationic compound mixture will be about neutral.

25. A process for making a soft, absorbent tissue paper web according to claim 24, wherein the cationic compound is cationic quatenary ammonium compound.

26. A process for making a soft, absorbent tissue paper web according to claim 24, wherein the molar ratio of anionic surfactant to cationic compound in the softener system is from about 0.5 to about 1.5.

27. A process for making a soft, absorbent tissue paper web according to claim 26, wherein the molar ratio of anionic surfactant to cationic compound in the softener system is from about 0.75 to about 1.25.

28. A process for making a soft, absorbent tissue paper web according to claim 24, wherein said anionic surfactant is selected from carboxylates, sulfonates, sulfates, alkyl phosphates, and anionic silicone surfactants.

29. A process for making a soft, absorbent tissue paper web according to claim 24, wherein said anionic surfactant is an alkenyl olefin sulfonate.

30. A process for making a soft, absorbent tissue paper web according to claim 24, wherein said anionic surfactant is a alkenyl olefin sulfonate comprising a carbon chain containing least about 16 carbon atoms.

31. A process for making a soft, absorbent tissue paper web according to claim 24, wherein said cationic compound is s elected from the group of imidazolines which includes 3-methyl-2-alkyl-1-(2-alkylamidoethyl)imidazolinium methyl sulfate; cationic fatty amine amides; dialkyl dimethyl quaternary ammonium compounds; diamidoamine-based quaternary ammonium compounds; monomethyl trialkyl-based quaternary ammonium compounds; monoalkyl trimethyl quaternary ammonium compounds; tetra alkyl quaternary ammonium compounds; methyl dialkoxy alkyl quaternary ammonium compounds; and cationic silicone compounds.

32. A process for making a soft, absorbent tissue paper web according to claim 31, wherein said cationic compound is an imidazolinium which includes 3-methyl-2-alkyl-1-(2-alkylaminidoethyl)imidazolinium methyl sulfate.

33. A process according to claim 32, wherein said cationic compound is a 3-methyl-2-tallow-1-(2-tallowamidoethyl) imidazolinium methylsulfate.

34. A process according to claim 31, wherein said anionic surfactant is an alkenyl olefin sulfonate comprising a carbon chain containing at least about 16 carbon atoms.

35. A process according to claim 33, wherein said anionic surfactant is an alkenyl olefin sulfonate.

* * * * *